US005725022A

United States Patent [19]

Taka et al.

[11] Patent Number: 5,725,022

[45] Date of Patent: Mar. 10, 1998

[54] DIRECTION CONTROL VALVE

[75] Inventors: Keisuke Taka; Kazunori Ikei, both of Tochigi-ken, Japan

[73] Assignee: Komatsu Ltd., Tokyo, Japan

[21] Appl. No.: 714,075

[22] PCT Filed: Mar. 15, 1995

[86] PCT No.: PCT/JP95/00438

§ 371 Date: Sep. 10, 1996

§ 102(e) Date: Sep. 10, 1996

[87] PCT Pub. No.: WO95/25227

PCT Pub. Date: Sep. 21, 1995

[30] Foreign Application Priority Data

Mar. 15, 1994 [JP] Japan ..... 6-44063

[51] Int. Cl.[6] ..... F15B 13/08

[52] U.S. Cl. ..... 137/596; 137/312; 137/884

[58] Field of Search ..... 137/312, 596, 137/596.13, 884

[56] References Cited

U.S. PATENT DOCUMENTS

| | | | |
|---|---|---|---|
| 3,194,265 | 7/1965 | Tennis | 137/596.12 X |
| 3,464,444 | 9/1969 | Tennis | 137/596.12 |
| 3,881,512 | 5/1975 | Wilke | 137/596.13 |
| 4,430,927 | 2/1984 | Turnbull | 137/596.13 X |
| 5,485,864 | 1/1996 | Takeuchi et al. | 137/118.07 |

FOREIGN PATENT DOCUMENTS

| | | |
|---|---|---|
| 55-126062 | 9/1980 | Japan . |
| 60-86601 | 6/1985 | Japan . |
| 5-42703 | 6/1993 | Japan . |

*Primary Examiner*—Gerald A. Michalsky
*Attorney, Agent, or Firm*—Ronald P. Kananen

[57] ABSTRACT

A direction control valve is constructed in such a manner that a spool bore having an inlet port, an actuator port and a tank port is formed in a valve block, a spool slidable between positions for establishing and blocking communication of the input port, the actuator port and the tank port, is disposed within the spool bore, the input port and the tank port open to a first mateable surface and a second mateable surface of the valve block, and a plurality of the valve blocks are stacked and connected with mating the first mateable surface and the second mateable surface for establishing communication between the input ports and between the tank ports of the valve blocks. An annular groove is formed in the second mateable surface of the valve block at a position outside of the ports, a drain confluence passage communicating with the annular groove is formed with opening in the first mateable surface and the second mateable surface, an oil seal for sealing between the spool bore and the spool is provided and the back surface side of the oil seal is communicated with the annular groove.

4 Claims, 11 Drawing Sheets

DIRECTION CONTROL VALVE

FIELD OF THE INVENTION

The present invention relates to a stack type direction control valve to be employed in a pressurized fluid supply system for supplying a discharged pressurized fluid of a hydraulic pump to a plurality of actuators. More specifically, the invention relates to a direction control valve for constructing a direction control apparatus by stacking a plurality of direction control valves with mating mateable surfaces thereof and connecting therebetween.

BACKGROUND ART

As a pressurized fluid supply system for supplying a discharged pressurized fluid of a single hydraulic pump to a plurality of actuators, one disclosed in Japanese Unexamined Utility Model Publication (Kokai) No. Heisei 5-42703 has been known.

As shown in FIG. 1, the disclosed system is provided with a plurality of direction control valves 3 in a discharge passage 2 of a hydraulic pump 1, each of which the direction control valves 3 is provided with a pressure compensation valve 6 having a check valve portion 4 and a pressure reduction valve portion 5 at the inlet side thereof. A load pressure is introduced into a load pressure detecting passage 7 by the pressure reduction valve portion 5. Then, a direction control valve 8 for adjustment of the pump is switched by the load pressure and a pump discharge pressure in the discharge passage 2 and the pump discharge pressure is supplied to a servo cylinder 9. Thus, a displacement of the hydraulic pump 1 is controlled.

As the conventional direction control valve 3 to be employed in such pressurized fluid supply system, one disclosed in Japanese Unexamined Utility Model Publication No. Heisei 5-42703 has been known.

As shown in FIGS. 2 and 3, the direction control valve is constructed by forming a spool bore 11, a check valve bore 12 and a pressure reduction valve bore 13 in a valve block 10. The valve block 10 is further formed with an inlet port 14, first and second load pressure detecting ports 15 and 16, first and second actuator ports 17 and 18, first and second tank ports 19 and 20, and a tank confluence port 21 respectively opening to the spool bore 11. On a mateable surface of the valve block 10 to be mated with another valve block, a recessed groove 22 communicated with the first and second tank ports 19 and 20 and the tank confluence port 21 is formed. A main spool 23 for establishing and blocking communication of respective ports is disposed in the spool bore 11. Thus, the direction control valve is formed. The valve block 10 is further formed with a pump port 24 opening to the check valve bore 12, and a fluid passage 25 for communicating the check valve bore to the inlet port 14. A spool 26 which establishes and blocks communication between the pump port 24 and the fluid passage 25 and stops at the communication blocking position, is disposed within the check valve bore 12. Thus, the check valve portion 4 is formed. Furthermore, the valve block 10 is formed with first and second ports 27 and 28 opening to the pressure reduction valve bore 13. A spool 29 is disposed within the pressure reduction valve bore 13 for defining first pressure chamber 30 and a second pressure chamber 31 at both ends thereof. The first pressure chamber 30 is communicated with the second load pressure detecting port 16 and the second pressure chamber 31 is communicated with the second port. The spool 29 is biased in one direction by a spring 32 to urge the spool 26 of the check valve 4 to the communication blocking position. Thus, the pressure reducing valve portion 5 is formed. Then, the pressure compensation valve 6 is formed with the pressure reducing valve portion 5 and the check valve portion 4.

In order to form the stack type direction control valve employing such direction control valves, the mateable surfaces of the valve blocks of a plurality of direction control valves are mated and connected for establishing communication between pump ports 24, between the first ports 27 and between second ports 28, as shown in FIG. 4. Also, respective of the first and second tank ports 19 and 20 are communicated with the tank confluence ports 21 via the recessed groove 22. The discharge passage 2 of the hydraulic pump 1 is connected with the pump port 24 and the first port 27, the second port 28 is connected to the load pressure detecting passage 7, and a tank passage 33 is connected to the tank confluence port 21.

Thus, the direction control valve 3 and the pressure compensation valve 6 are constructed in compact construction within the valve block 10. Furthermore, by stacking and connecting a plurality of valve blocks 10 and communicating respective first and second tank ports 19 and 20 of respective valve blocks 10 to the tank confluence ports 21 to make their connection to the tank passage 33 simple.

Thus, when the stack type direction control valve apparatus is constructed employing a plurality of direction control valve, respective of the first and second tank ports 19 and 20 are communicated to be connected to one tank passage 33. However, since return fluid of the actuators flows into the first and second tank ports 19 and 20, the back pressure becomes high. As a result, the pressure of the pressurized fluid flowing through the first and second tank ports 19 and 20 becomes higher than atmospheric pressure.

Therefore, to an oil seal 34 sealing between the spool bore 11 and the spool 23 in FIG. 2, for example, the pressurized fluid having higher pressure than the atmospheric pressure acts to press the oil seal 34 onto the spool 23 to increase sliding resistance of the spool 23 to lower operability thereof.

On the other hand, as shown in FIG. 1, the load pressure detecting passage 7 is connected to a tank 36 via an orifice 35. When the same construction is employed in FIG. 2, the second pressure receiving chamber 28 may be connected to the first or second tank port 19 or 20 via an orifice. However, in such constriction, since the pressurized fluid flowing through the first and second tank ports 19 and 20 has higher pressure than the atmospheric pressure for affecting to displacement control of the hydraulic pump 1 to cause error. Also, connection structure becomes quite troublesome.

The present invention has been worked out for improving such drawbacks. An object of the present invention is to provide a direction control valve which can reduce sliding resistance of the spool and can avoid back pressure acting on the load pressure detecting passage.

DISCLOSURE OF THE INVENTION

In order to accomplish the above-mentioned object, according to one aspect of the invention, a direction control valve, in which a spool bore having an inlet port, an actuator port and a tank port is formed in a valve block, a spool slidable between positions for establishing and blocking communication of the input port, the actuator port and the tank port, is disposed within the spool bore, the input port and the tank port open to a first mateable surface and a second mateable surface of the valve block, and a plurality of the valve blocks are stacked and connected with mating the first mateable surface and the second mateable surface for establishing communications between the input ports and between the tank ports of the valve blocks, is characterized in that an annular groove is formed in the second mateable surface of the valve block at a position outside of the ports, a drain confluence passage communicating with the annular groove is formed with opening in the first mateable surface and the second mateable surface, an oil seal for sealing between the spool bore and the spool is provided and the back surface side of the oil seal is communicated with the annular groove.

With the construction set forth above, since the annular groove is not communicated with the tank port and communicated with the tank independently, back pressure may not act on the fluid flowing in the annular groove and drain confluence passage, and the pressure therein becomes low substantially equal to the atmospheric pressure. Then, the annular groove is communicated with the back surface side of the oil seal provided between the spool bore and the spool, the pressure at the back surface side becomes substantially equal to the atmospheric pressure so that the oil seal may not be strongly pressed onto the spool. Thus, sliding resistance of the spool can be lowered.

In addition, the since the annular groove is communicated via the drain confluence passage by stacking and connecting a plurality of valve blocks, it is required to communicate only one annular groove to the tank. Thus, construction can be simplified.

In addition to the construction set forth above, the load pressure detecting passage may be communicated with the annular groove via an orifice so that the load pressure detecting passage may be communicated with the drain passage, to which the back pressure does not act.

In another aspect of the invention, a direction control valve, in which a spool bore having an inlet port, an actuator port and a tank port is formed in a valve block, a spool slidable between positions for establishing and blocking communication of the input port, the actuator port and the tank port, is disposed within the spool bore, the input port and the tank port open to a first mateable surface and a second mateable surface of the valve block, and a plurality of the valve blocks are stacked and connected with mating the first mateable surface and the second mateable surface for establishing communications between the input ports and between the tank ports of the valve blocks, CHARACTERIZED in that an annular groove is formed in the second mateable surface of the valve block at a position outside of the ports, an O-ring having smaller width than the groove width of the annular groove is mounted at a position beside the outer periphery of the annular groove for defining a drain passage between the O-ring and the inner periphery of the annular groove, a drain confluence passage communicating with the drain passage is formed with opening in the first mateable surface and the second mateable surface, an oil seal for sealing between the spool bore and the spool is provided and the back surface side of the oil seal is communicated with the drain passage.

In addition to the construction set forth above, the load pressure detecting passage may be communicated with the drain passage via an orifice.

In this another aspects, similar effect to that achieved by the foregoing aspects may be attained.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

BEST MODE FOR IMPLEMENTING THE INVENTION

Figure 1:
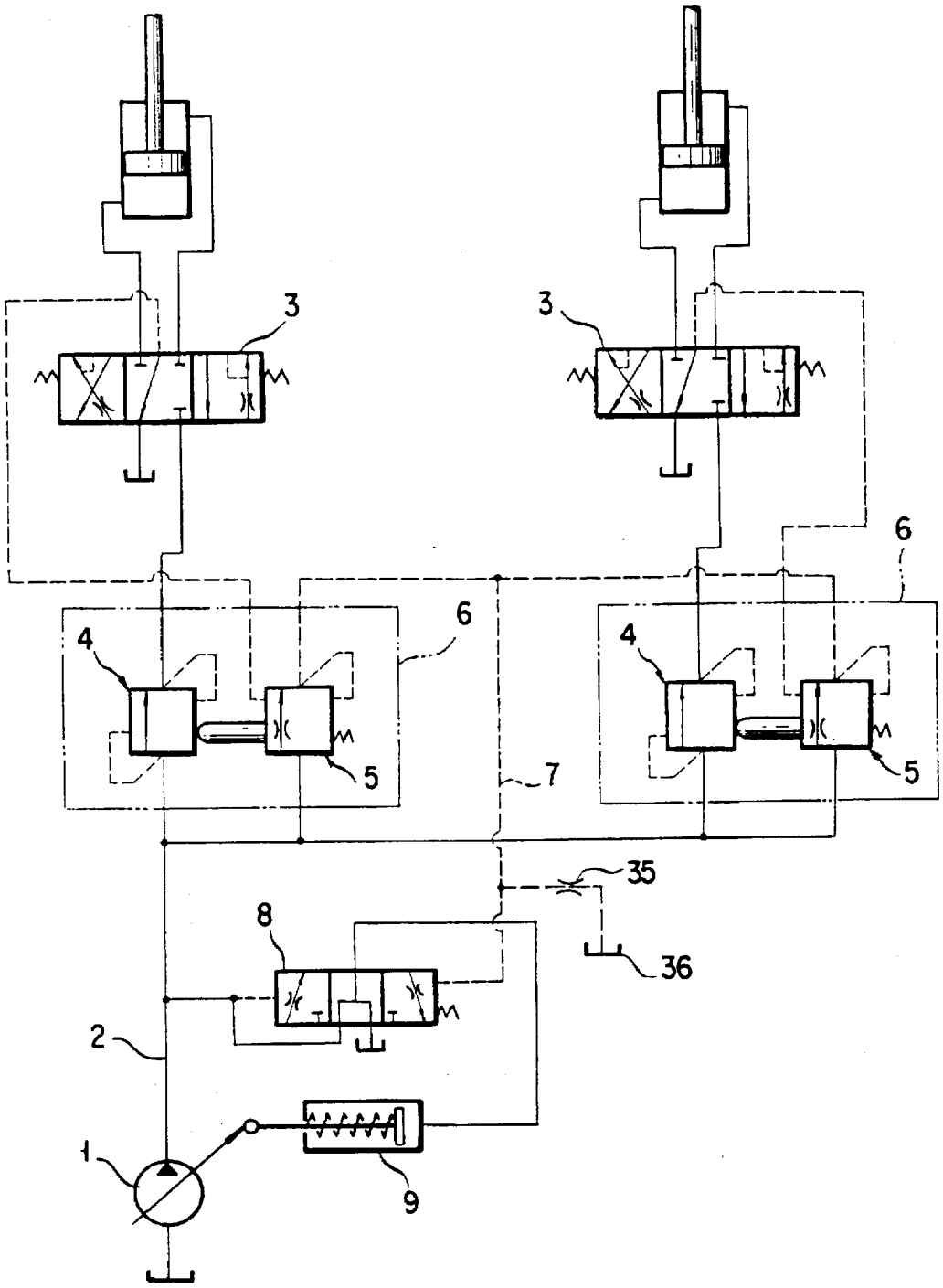
FIG. 1 is a hydraulic circuit diagram of the conventional pressurized fluid supply system.
Figure 2:
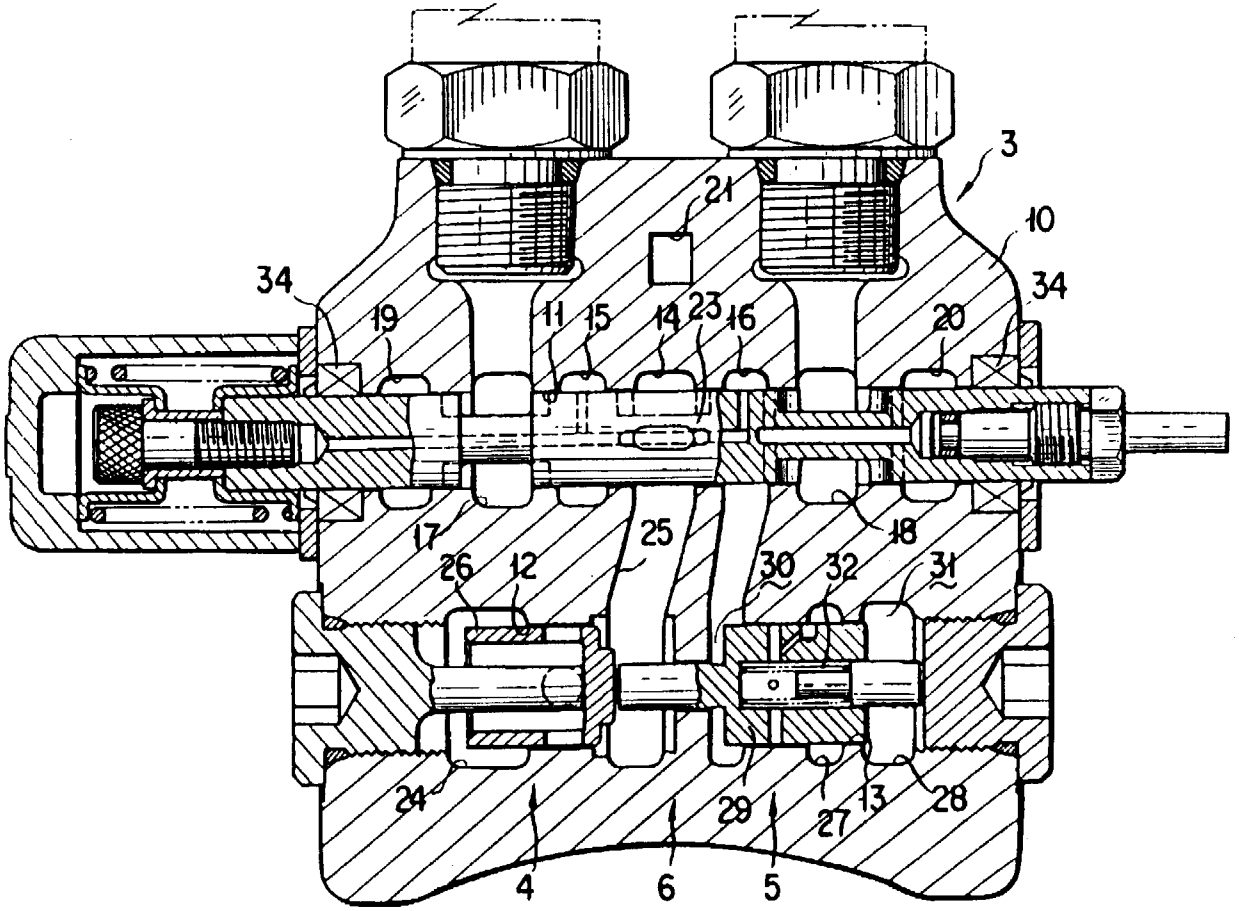
FIG. 2 is a section of a direction control valve to be employed in the pressurized fluid supply system set forth above.
Figure 3:
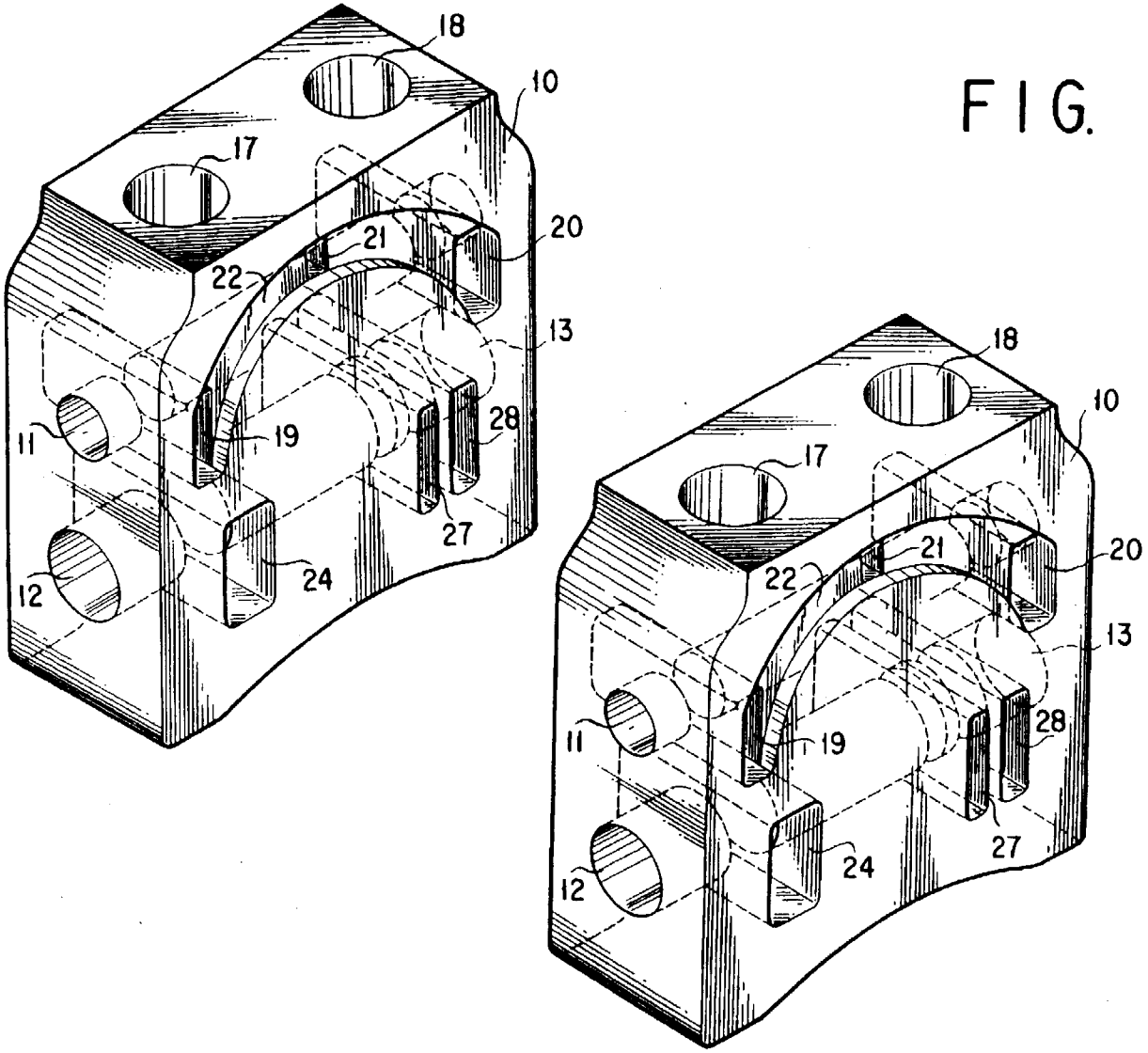
FIG. 3 is a perspective view of a valve block of the direction control valve set forth above.
Figure 4:
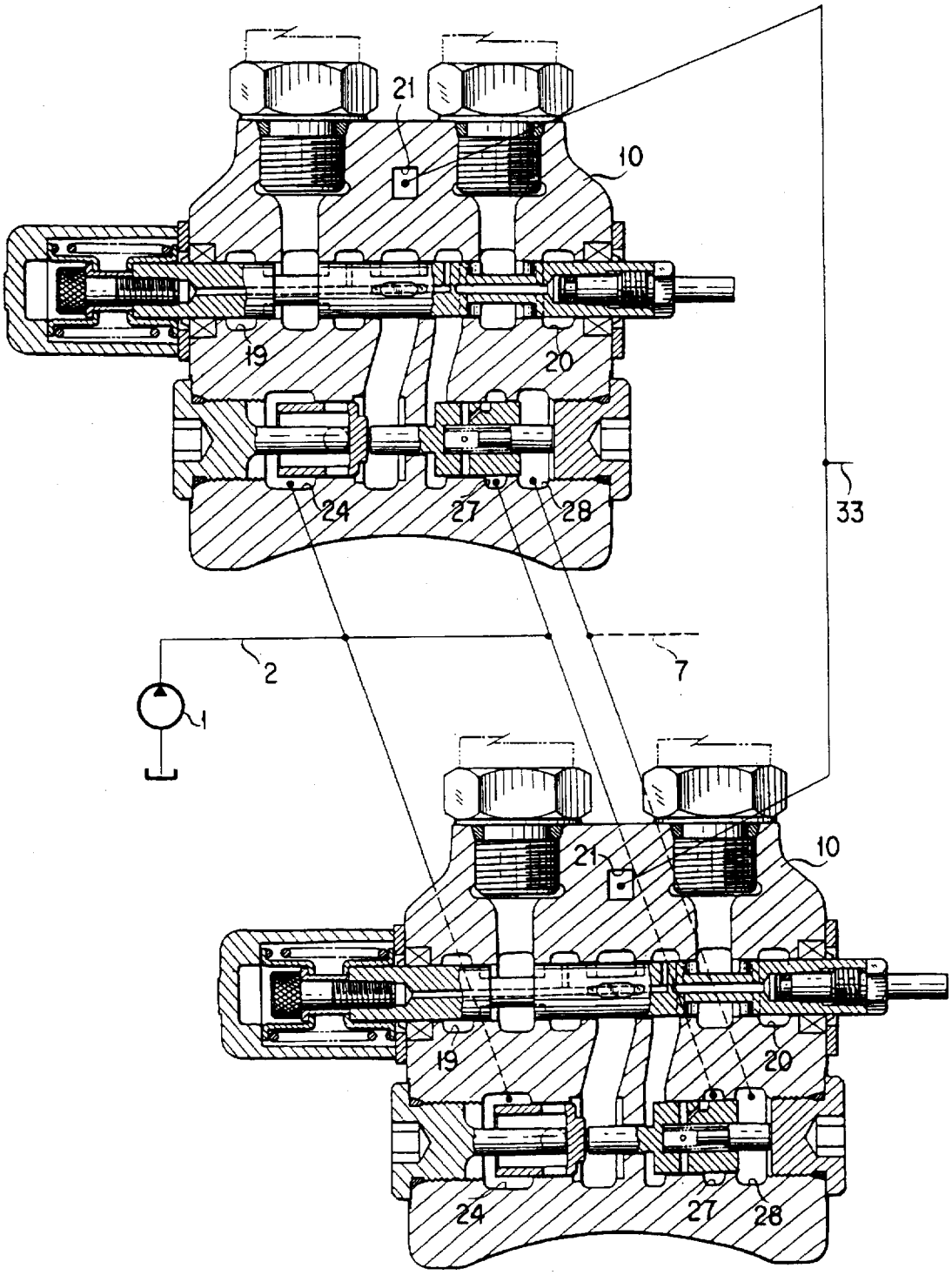
FIG. 4 is an explanatory illustration showing communicating state of ports of the direction control valves set forth above.
Figure 5:
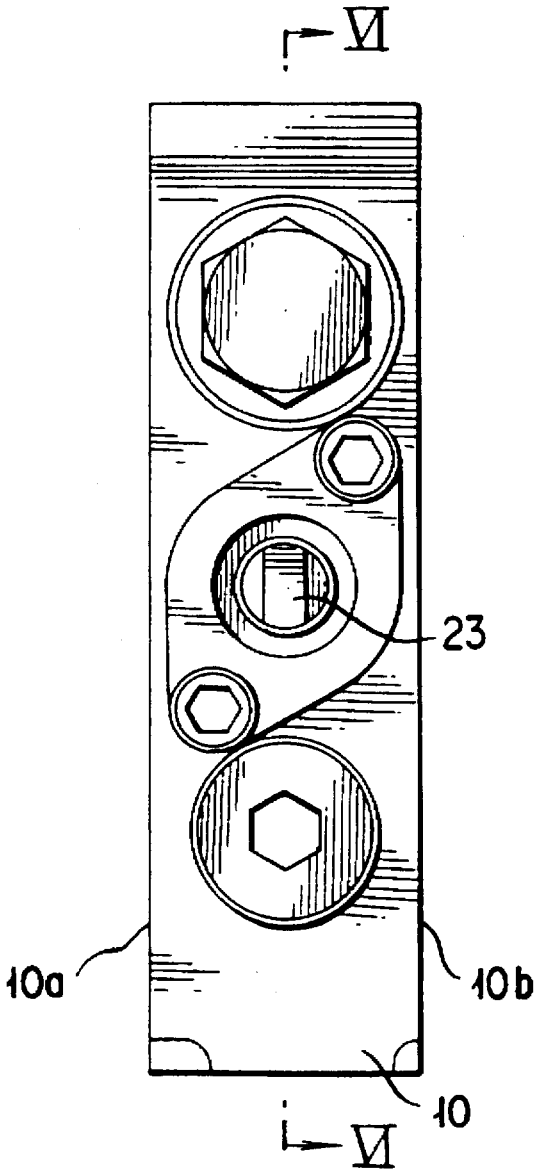
FIG. 5 is a front elevation of one embodiment of the direction control valve according to the present invention.

The preferred embodiment of a direction control valve according to the present invention will be discussed with reference to FIGS. 5 to 11. It should be noted that like components as components of the conventional system will be identified by the same reference numerals.

Figure 6:
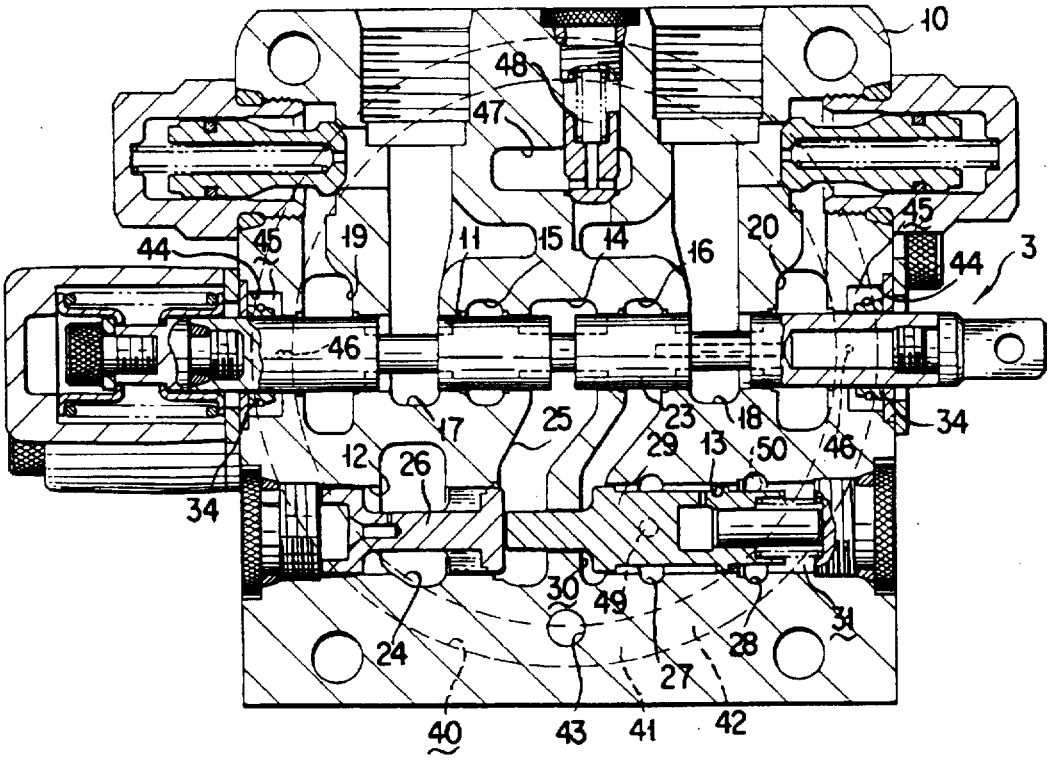
FIG. 6 is a section taken along line VI—VI of FIG. 5.
Figure 7:
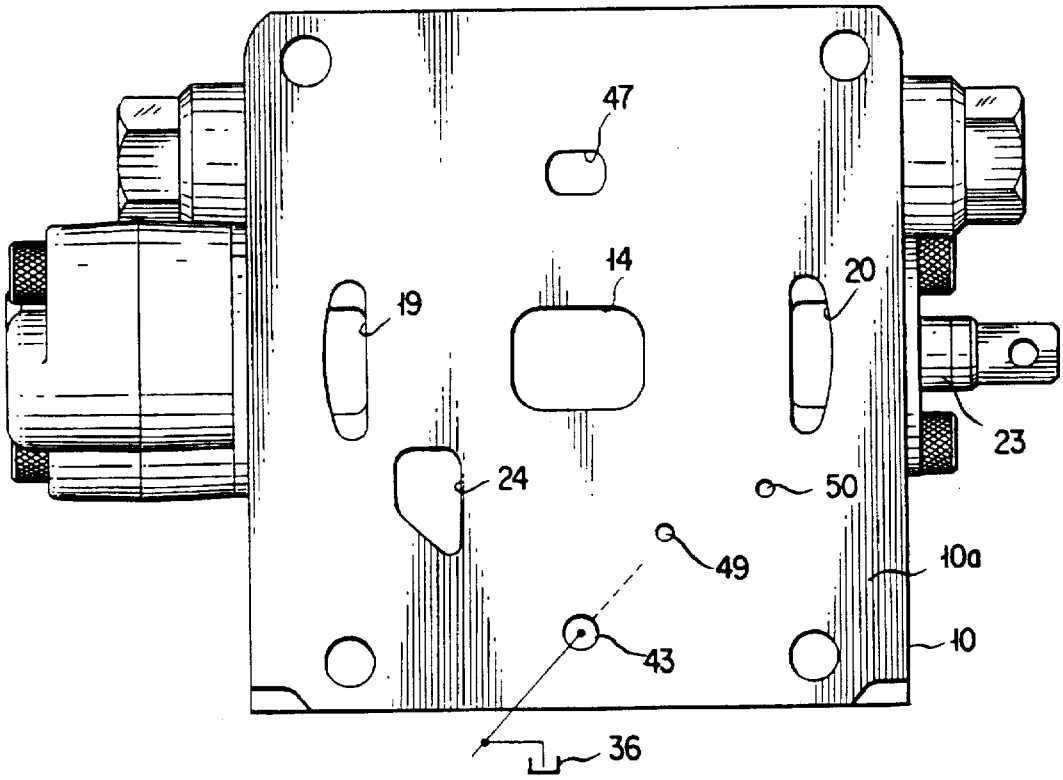
FIG. 7 is a left side elevation of FIG. 5.
Figure 8:
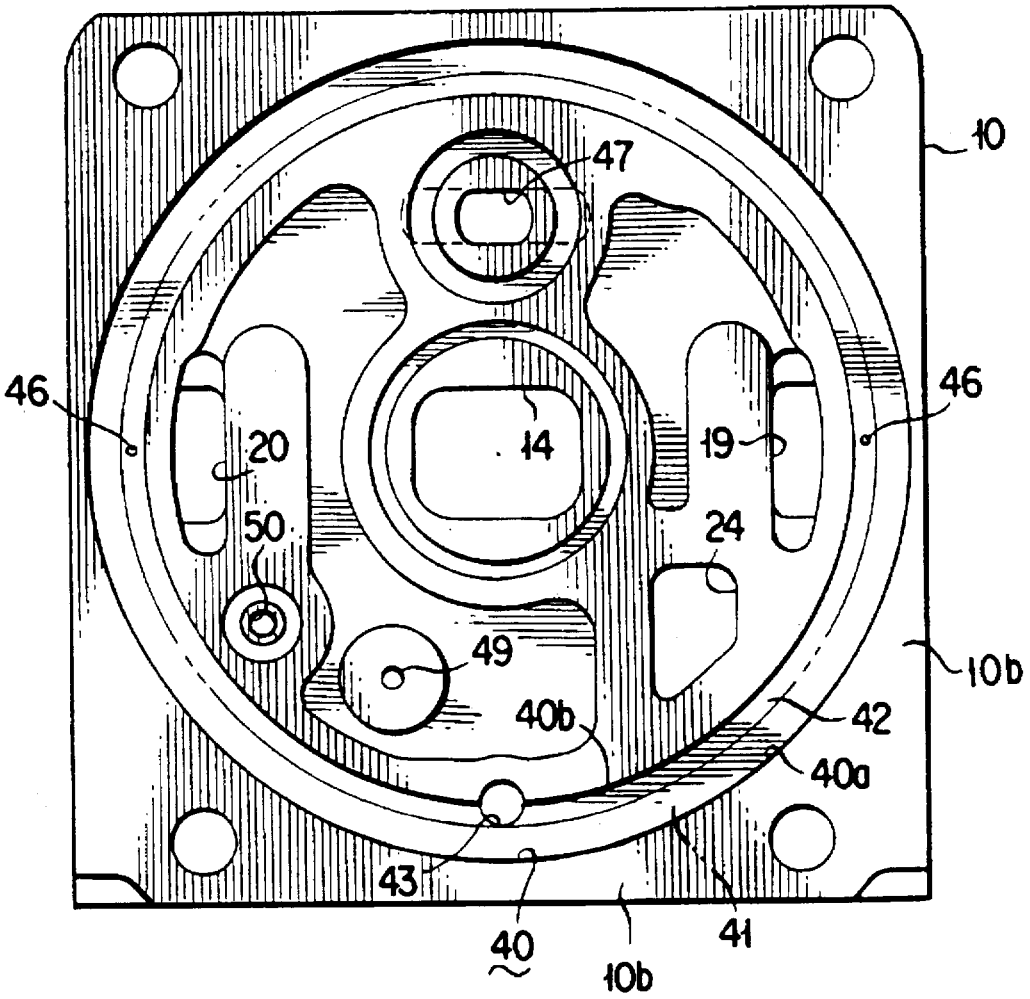
FIG. 8 is a right side elevation of FIG. 5.
Figure 9:
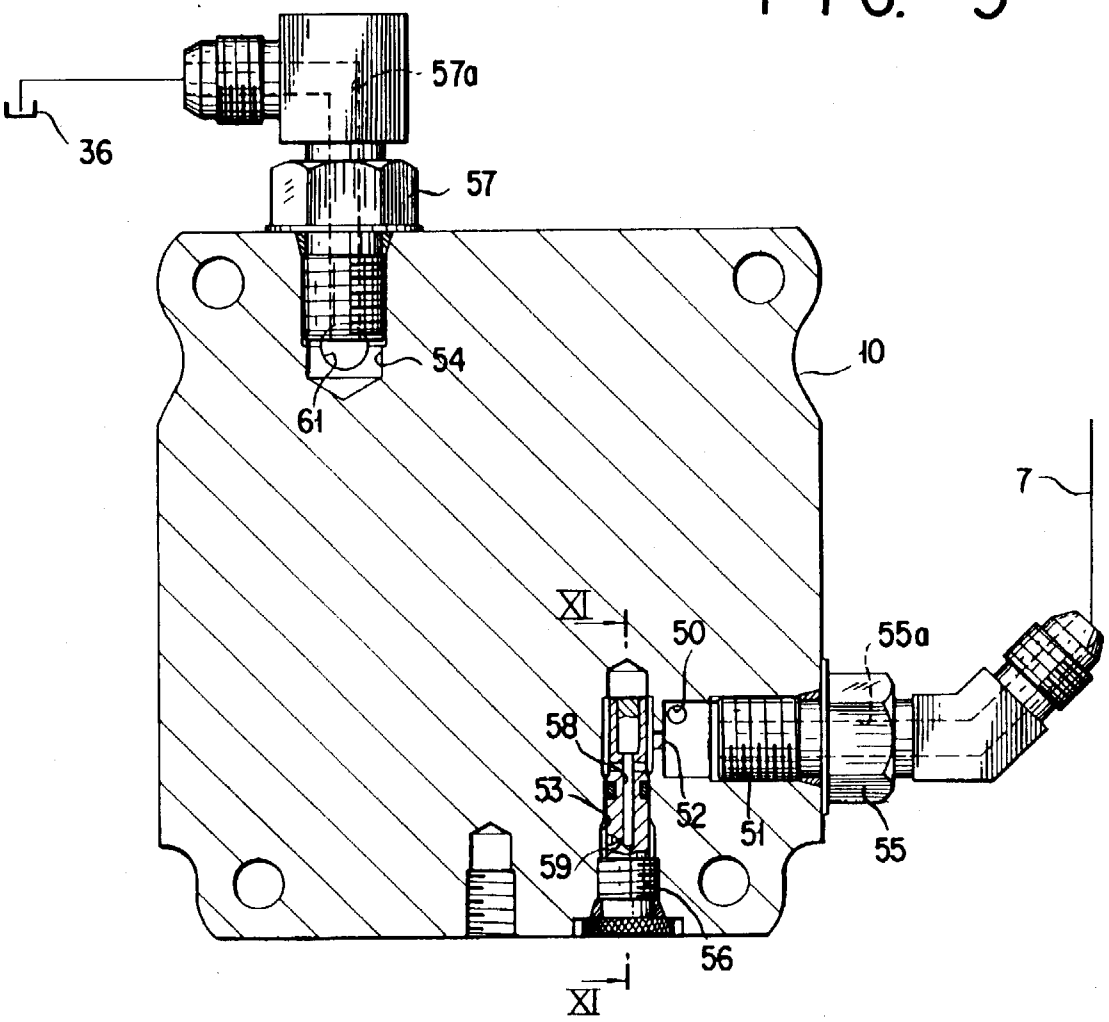
FIG. 9 is a section of the valve block at the distal end portion of a direction control valve apparatus forming by the embodiments.

The input port 14, the first and second ports 19 and 20 and the pump port 24 shown in FIG. 6 are opened to first mateable surface 10*a* and second mateable surfaces 10*b* of the valve block 10, as shown in FIGS. 7 and 8. At the outer side of the second mateable surface 10*b* of the valve block 10, an annular groove 40 for being mounted with an O-ring for sealing between the mateable surfaces 10*a* and 10*b* of the valve blocks, is formed. The groove width of the annular groove 40 is wider in width than the O-ring 41 so that the O-ring 41 is mounted at the position beside the outer periphery 40*a* of the annular groove 40 and a drain passage 42 which is independent of the first and second tank ports 19 and 20, can be defined between the inner periphery 40*b* and the O-ring 41. Then, the drain passage 42 is opened to the first mateable surface 10*a* via a drain confluence passage 43.

Thus, by stacking and connecting a plurality of valve blocks 10 with mating the first mateable surface 10*a* and the second mateable surface 10*b*, respective drain passages 42 are communicated. Furthermore, since the drain passages 42 are not communicated with the first and second tank ports 19 and 20 and thus independently communicated with the tank 36, the inside of the drain passages 42 become low pressure substantially equal to the atmospheric pressure.

As shown in FIG. 6, at both longitudinal end portions of the spool bore 11 of the valve block, large diameter bore portions 44 opening to both end surfaces are formed. Within these large diameter bore portions 44, oil seals 34 are provided, and spaces 45 are defined with the back surface of the oil seals 34. These spaces 45 are opened and thus communicated to the drain passage 42 via small diameter conduits 46, as shown in FIGS. 6 and 8.

With such construction, the pressurized fluid leaking from a gap between the spool bore 11 and the spool 23 into the back surface side (space 45) of the oil seal 34 flows into drain passage 42 through the small diameter conduit 46. Accordingly, the pressure higher than the atmospheric pressure will never act on the back surface side of the oil seal 34. Thus, sliding resistance of the spool 23 will not be increased due to pressing of the oil seal 34 onto the spool 23 as in the prior art.

As shown in FIG. 6, a pressure introduction port 47 is formed in the valve block 10. The pressure introduction port 47 opens to first and second actuator ports 17 and 18 via a pair of check valves 48. Furthermore, the pressure introduction port 47 opens to first and second mateable surfaces 10*a* and 10*b* of the valve block 10, as shown in FIGS. 7 and 8.

As shown in FIGS. 6, 7 and 8, in the valve block 10, a first communication port 49 opening to the first port 27 and a second communication port 50 opening to the second port 28 are formed respectively opening to the first and second mateable surfaces 10*a* and 10*b*. When respective of the valve blocks 10 are stacked and connected to each other, communication may be established between the first ports and between the second ports, mutually.

In the valve block 10 located at the distal end portion of the direction control valve apparatus formed by stacking a plurality of valve blocks, a first blind hole 51 opening to the second communication port 50, second blind hole 53 communicated with the first blind hole 51 via a conduit 52 and third blind hole 54 are formed. In the first blind bore 51, a first plug 55 is threadingly engaged. To the second blind bore 53, a sleeve 56 is threadingly engaged. Also, a second plug 57 is threadingly engaged with the third blind bore 54.

Figure 10:
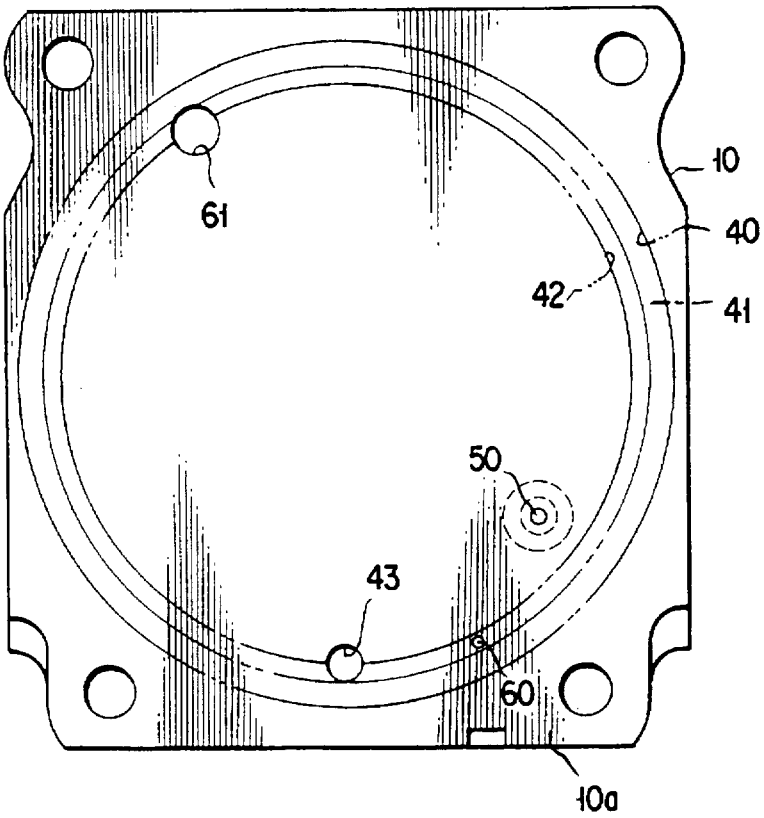
FIG. 10 is a side elevation of the valve block shown in FIG. 9.
Figure 11:
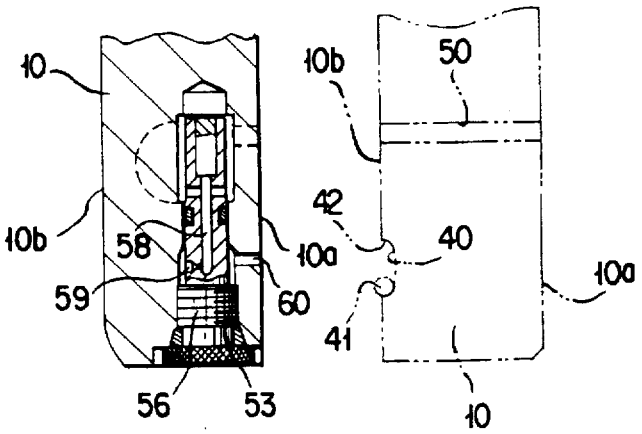
FIG. 11 is a side elevation taken along line XI—XI of FIG. 9.
Figure 12:
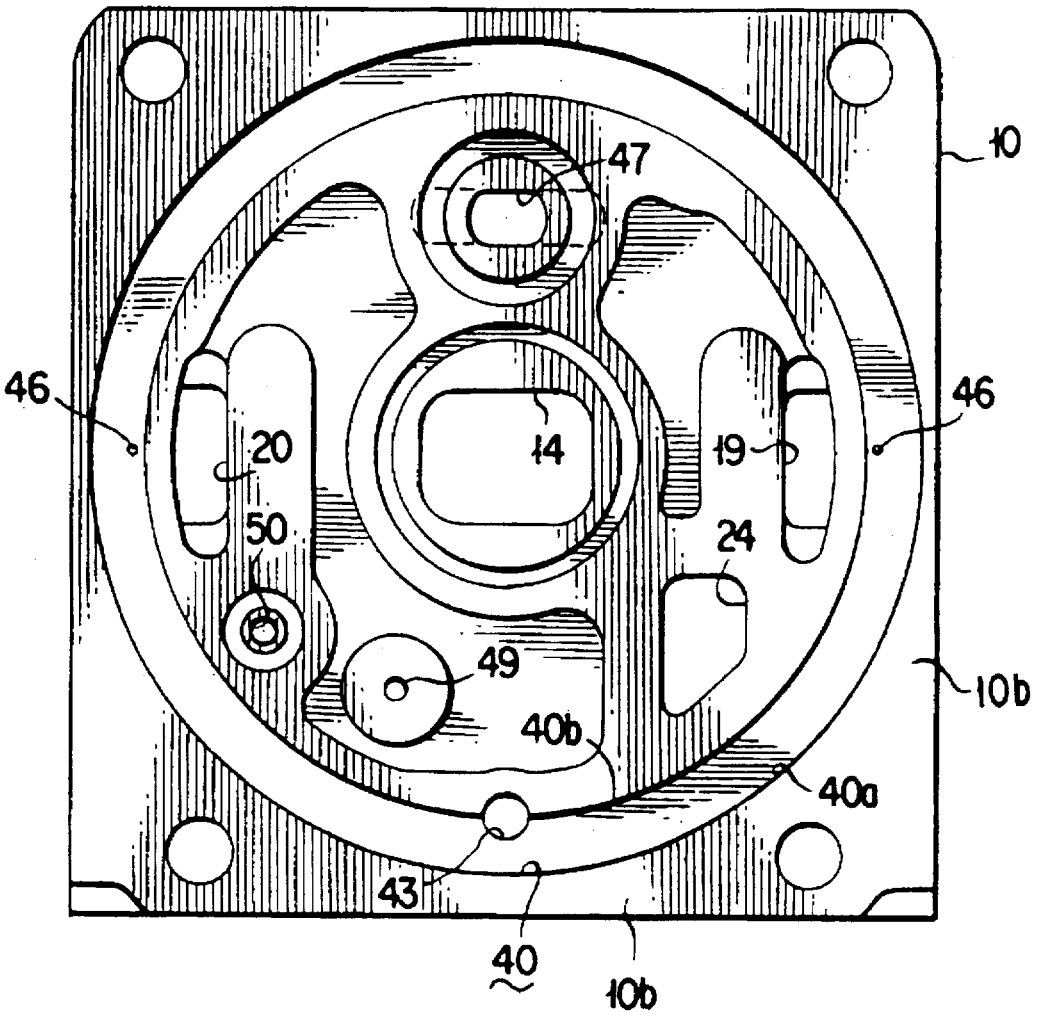
FIG. 12 is a right side elevation of another embodiment of the direction control valve according to the present invention.

In the first plug 55, a load pressure taking out opening 55*a* is formed. The load pressure taking out opening 55*a* is connected to the load pressure detecting passage 7. On the other hand, in the sleeve 56, an axial bore 58 and an orifice 59 are formed so that the conduit 52 is communicated with a draining small conduit 60, as shown in FIG. 11. The draining small conduit 60, as shown in FIG. 10, opens to the first mateable surface 10*a* of the valve block 10 so that it may be communicated with the drain passage 42 opening in the second mateable surface 10*b* of the adjacent valve block 10 stacked and connected with mated to the first mateable surface 10*a*. On the other hand, a load pressure taking out opening 57*a* of the second plug 57 is communicated with the tank 36. The third blind bore 54 opens to the first mateable surface 10*a* via a drain hole 61 so as to be communicated with the drain passage 42 of the second mateable surface 10*b* of the adjacent valve block 10.

With the construction set forth above, the second communication ports 50 of respective valve blocks 10 are connected to a load pressure detecting passage 7. One of the second communication port 50 is communicated with the drain passage 42 via an orifice 59. Therefore, the load pressure detecting passage 7 is communication with the drain passage 42 which is situated at low pressure substantially equal to the atmospheric pressure. Thus, influence of the back pressure can be successfully avoided. Also, first and second blind bores 51 and 53, the conduit 52 and draining small conduit 60 are formed in the valve block 10 located at distal end portion, so that the sleeve 56 may be mounted with threading with the second blind bore 53, the construction can be simplified. On the other hand, the fluid flowing through the drain passage 42 of each valve block 10 flows into the tank 36 through the second plug 57, the second plug 57 can be mounted to the only valve block 10 at the distal end portion. Thus, the construction can be simplified.

With the embodiment set forth above, since the drain passage 42 is not communicated with the tank port and communicated with the tank 36 independently, no back pressure will act on the fluid flowing through the drain passage 42 and the drain confluence passage 43 so that the pressure therein is substantially equal to the atmospheric pressure. Also, since the drain passage 42 is communicated with the back surface side of the oil seal 34 provided between the spool bore 11 and the spool 23, the pressure at the back surface side can be maintained at a pressure substantially equal to the atmospheric pressure. Thus, oil seal 34 may not be strongly pressed toward the spool 11. Therefore, sliding resistance of the spool 11 can be lowered.

In addition, since the drain passages 42 are communicated with each other by stacking and connecting a plurality of valve blocks 10 via the drain confluence passage 43, it is required to communicate only one drain passage 42 to the tank. Thus, the structure can be simplified.

On the other hand, the load pressure detecting passage 7 is communicated with the drain passage 42 via the orifice. Thus, the load pressure detecting passage 7 can be communicated with the drain passage, to which the back pressure does not act.

It should be noted that while the pressure compensation valve 6 constituted of the check valve portion 4 and the pressure reducing valve portion 5 is provided in the valve block 10, in the shown embodiment, it may be possible to form the pressure compensation valve 6 separately from the valve block 10. On the other hand, while the drain passage 42 is defined by providing the O-ring 41 in the annular groove 40, as alternative embodiment, it is possible to use the annular groove 40 per se as the drain passage without providing the O-ring 41. In such case, equivalent effect to the foregoing embodiment can be attained.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A direction control valve, in which a spool bore having an inlet port, an actuator port and a tank port is formed in a valve block, a spool slidable between positions for establishing and blocking communication of said input port, said actuator port and said tank port, is disposed within said spool bore, said input port and said tank port open to a first mateable surface and a second mateable surface of said valve block, and a plurality of such valve blocks are stacked and connected with mating the first mateable surface and the second mateable surface for establishing communications between said input ports and between said tank ports of said valve blocks, CHARACTERIZED in that an annular groove is formed in said second mateable surface of said valve block at a position outside of said ports, a drain confluence passage communicating with a drain passage is formed with an opening in said first mateable surface and said second mateable surface, an oil seal for sealing between said spool bore and said spool is provided and a back surface side of said oil seal is communicated with said annular groove.

2. A direction control valve as set forth in claim 1, wherein a load pressure detecting passage is communicated with said annular groove via an orifice.

3. A direction control valve, in which a spool bore having an inlet port, an actuator port and a tank port is formed in a valve block, a spool slidable between positions for establishing and blocking communication of said input port, said actuator port and said tank port, is disposed within said spool bore, said input port and said tank port open to a first mateable surface and a second mateable surface of said valve block, and a plurality of such valve blocks are stacked and connected with mating the first mateable surface and the second mateable surface for establishing communication between said input ports and between said tank ports of said valve blocks, CHARACTERIZED in that an annular groove is formed in said second mateable surface of said valve block at a position outside of said ports, an O-ring having a smaller width than the groove width of said annular groove is mounted at a position beside an outer periphery of said annular groove for defining a drain passage between said O-ring and an inner periphery of said annular groove, a drain confluence passage communicating with said drain passage is formed with an opening in said first mateable surface and said second mateable surface, an oil seal for sealing between said spool bore and said spool is provided and a back surface side of said oil seal is communicated with said drain passage.

4. A direction control valve as set forth in claim 3, wherein a load pressure detecting passage is communicated with said drain passage via an orifice.

* * * * *